United States Patent [19]

Camp et al.

[11] 4,003,739

[45] Jan. 18, 1977

[54] COPPER EXTRACTION BY ARC HEATER

[75] Inventors: Floyd E. Camp, Trafford; Chikara Hirayama, Murrysville, both of Pa.

[73] Assignee: Westinghouse Electric Corporation, Pittsburgh, Pa.

[22] Filed: June 16, 1975

[21] Appl. No.: 587,762

[52] U.S. Cl. ..... 75/72; 75/74; 75/65 R

[51] Int. Cl.[2] ..... C22B 15/00

[58] Field of Search ..... 75/72, 73, 74, 75, 10 R, 75/11, 65 R

[56] References Cited

UNITED STATES PATENTS

| | | | |
|---|---|---|---|
| 3,232,746 | 2/1966 | Karlovitz | 75/10 R |
| 3,459,415 | 8/1969 | Holeczy et al. | 75/72 |
| 3,765,870 | 10/1973 | Fey et al. | 75/10 R |
| 3,796,568 | 3/1974 | Szekely et al. | 75/74 |
| 3,893,845 | 7/1975 | Mahaffey et al. | 75/10 R |
| 3,932,171 | 1/1976 | Tylko | 75/10 R |

*Primary Examiner*—Walter R. Satterfield
*Attorney, Agent, or Firm*—L. P. Johns

[57] ABSTRACT

A single step process for converting copper ore to a metal characterized by the step of injecting powdered copper sulfide ($Cu_2S$) into an arc heated gas containing oxygen in an amount sufficient to yield elemental copper and sulfur dioxide ($SO_2$).

1 Claim, 2 Drawing Figures

COPPER EXTRACTION BY ARC HEATER

BACKGROUND OF THE INVENTION

1. Field of the Invention

This invention relates to a process for the reduction of copper from an ore and, more particularly, it pertains to the reduction of copper sulfide in an arc heater.

2. Description of the Prior Art

Of the three main types of copper ore, native, oxide, and sulfide, the sulfides are the most widely distributed throughout the world and constitute the major source of this very important metal. Present technology for extracting copper from sulfide based ores includes many separate steps. Initially, the core is pulverized then concentrated by a flotation process. After drying, the concentrated ore is heated in a furnace to obtain a molten mixture of copper and iron sulfides plus some slag. Iron is the main impurity in most copper ores. This mixture of "matte" is transferred to a converter where air is blown into the molten sulfides. The FeS is initially oxidized to FeO which then combines with any siliceous material to form $FeSiO_3$ slag. After all the iron has been oxidized, the remaining sulfur is selectively oxidized to $SO_2$ gas leaving metallic copper as the liquid product.

SUMMARY OF THE INVENTION

In accordance with this invention it has been found that the prior procedure for extracting copper from sulfide based ores may be improved upon by a one stage process by which the initial step of heating the ore and the converting operations are performed in a single step. This process comprises the step of introducing pulverized copper sulfide into arc heated gas containing oxygen in an amount sufficient to yield elemental molten copper and sulfur dioxide. Subsequently, the copper is cooled to room temperature to facilitate handling.

The advantage of the process of this invention is economical in that a three-step process incorporating two pieces of equipment becomes a single step process using an arc heater.

DESCRIPTION OF THE PREFERRED EMBODIMENT

The process of this invention comprises the step of introducing powdered copper sulfide into arc heated gas containing oxygen in an amount sufficient to yield elemental copper and sulfur dioxide. To facilitate handling the copper is subsequently cooled to room temperature.

Figure 1:
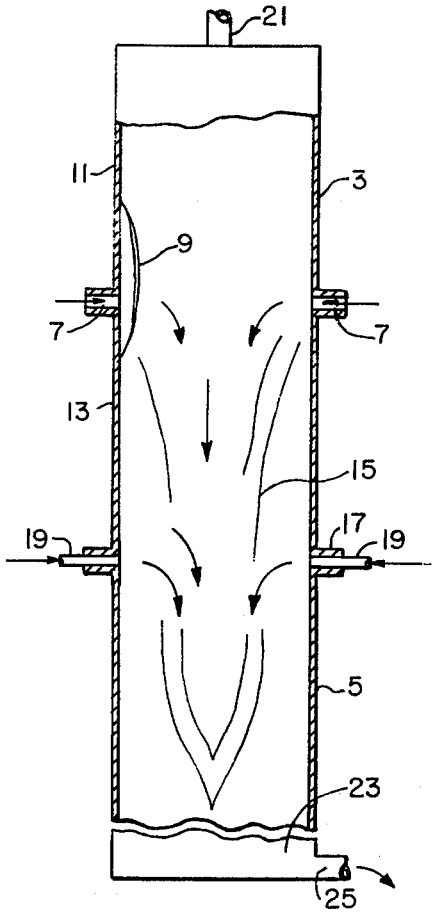
FIG. 1 is a diagrammatic sectional view of a reactor for extracting copper from copper sulfide ore.

The apparatus by which the process is practiced is that disclosed in FIG. 1 and it comprises an arc heater 3 and a reactor 5. The arc heater 3 is similar in construction and operation to the arc heater shown in U.S. Pat. No. 3,765,870, entitled "Method of Direct Ore Reduction Using A Short Gap Arc Heater", by Maurice G. Fey and George A. Kemeny, issued Oct. 16, 1973. Because of the full disclosure in that patent the description of the arc heater 3 is limited herein to the basic structure and operation. The arc heater 3 is a single phase, self-stabilizing AC device capable of power levels up to about 3500 kilowatts, or up to 10,000 kilowatts for a three phase plant installation. The arc heater 3 comprises an annular gap 7 into which oxygen containing gas, such as air, oxygen enriched air, and oxygen, are introduced into the arc heater chamber in which an arc 9 extends between electrodes 11 and 13 on opposite sides of the gap 7. An arc heated gas jet 15 extends downwardly from the gap into the reactor 5.

As shown in FIG. 1 a flange 17 is disposed at the joint between the arc heater 3 and the reactor 5 and the flange is provided with inlets 19 through which solid feed material consisting essentially of copper sulfide ($Cu_2S$) and with or without additional reducing gas such as oxygen are fed. In the alternative, finely divided copper sulfide ore may be admitted axially such as at an inlet 21 at the opposite end of the arc heater 3. Where air is used as the process gas, the following reaction occurs between the particles of ore and the oxygen in the air:

$$Cu_2S + O_2 \rightarrow 2Cu + SO_2$$

Once the reaction is started within the reactor 5, it continues on to completion because it is highly exothermic and has a large negative free energy change. The energy given off by the reaction can be utilized in preheating the copper ore and the air to temperatures above the normal melting point of copper (1083° C). Any additional energy requirements are supplied by the electric arc discharge of the arc heater 3 and these reequirements are minimized by the fact that there is an autogenous reaction occurring. Thus, within the reactor the reactants are subjected to a temperature ranging from about 2000° to 3500° K, and preferably at 2000 K.

As indicated above, the copper sulfide is pulverized prior to its introduction into the reactor 3 to a size of less than minus 200 mesh and preferably at mnus 325 mesh. Inasmuch as the ore is fed into the arc heater to obtain a maximum reaction, there is a maximum size for entraining the particles into gas stream 15 of the arc heater 3. The elemental copper 23 resulting from the reaction of the above equation accumulates in liquid form at the lower end of the reaction 5 from where it is drained at outlet 25 from time-to-time.

Figure 2:
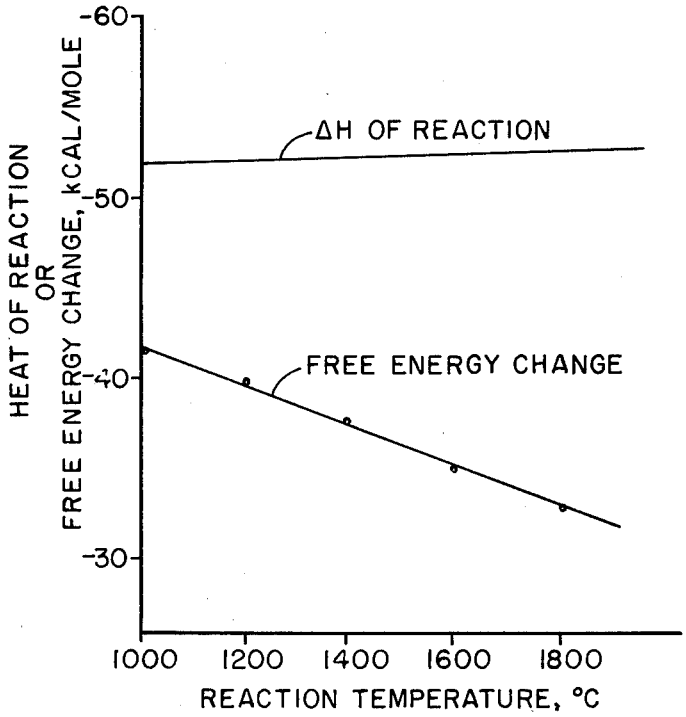
FIG. 2 is a graph showing heat of reaction and free energy change versus reaction temperature.

FIG. 2, showing how the heat of reaction and the free energy change are affected by the process temperature, is a thermodynamic graph illustrating that the negative free energy change is a favorable reaction. Moreover, once the reaction commences ($\Delta H$ of Reacton), it sustains itself because it is exothermic. There is a negligible change in the heat of reaction with the temperature interval (1000° C to 1800° C), but the larger free energy change occurs at the lower temperatures. Thermodynamically, the reaction is favored and goes to completion to a greater extent at the lower temperatures. Thus, the amount of product formed may be maximized while minimizing the energy input to the process. Ideally, the reaction should run at the melting point of copper, but practically the metal should be superheated to some extent to allow for further processing such as casting.

The following example is illustrative of the process of this invention:

EXAMPLE

Copper ore concentrate is used which contains 50 weight percent $Cu_2S$, 20 percent FeO, 12 percent Zn, and the balance $SiO_2$, $Al_2O_3$, CaO, and MgO, which is reacted with a stoichiometric amount of air. The energy input is approximately 73.5 kcal/mole $Cu_2S$ to heat the product to a temperature of 1125° C. Subtracting 52 kcal/mole $Cu_2S$ given up by the reaction results in 21.5 kcal/mole $Cu_2S$ of energy which remains to be supplied by the arc heater. This is equivalent to a 367 BTU/lb air enthalpy requirement, or 0.009 kwhr/lb copper for a theoretical specific energy requirement.

Arc heaters of the type described in the above mentioned patent have operated successfully on air up to 7000 BTU/lb air, leaving a significantly large region in which actual operation is performed. The above energy figures are ideal with only a 40° C superheat of the molten copper, based on an assumption of no excess air requirement and the complete utilization of the exothermic heat of reaction. Actually higher energy inputs are required. The arc heater operating range with air presents a wide latitude for making adjustments. Moreover, there is a wide variation in the composition of sulfide-based copper ore concentrates that necessitates wide operating ranges for the arc heater. Finally, the same principle that is presently used to separate major impurities, such as iron, are employable by the addition of adequate siliceous material for conversion of the impurities into easily discarded slag.

In conclusion, the method of extracting copper metal from its sulfide based ores incorporates electric arc discharge equipment to replace the presently used multi-step heating and conversion processes and the energy requirements are attractive due to the exothermic nature of the reaction between particles of copper sulfide and oxygen.

What is claimed is:

1. A process for the production of copper from copper sulfide ore comprising the steps of:

striking an electric arc in an axial gap between generally hollow, cylindrical electrodes spaced along a common axis which form an arc chamber;

passing a non-conductive gas consisting essentially of oxygen-containing gas selected from the group consisting of oxygen and air forcefully through the gap into the arc chamber and through the arc to produce an arc heated plasma jet while forming a downstream reaction zone;

injecting into the reaction zone a stream of powdered copper sulfide material to effect a reaction between said material and said oxygen-containing gas at a temperature ranging from about 2000° K to about 3500° K to produce molten copper and sulfur-dioxide; and cooling the copper to below its melting point.

* * * * *